United States Patent [19]

Talbert et al.

[11] Patent Number: 5,020,320

[45] Date of Patent: Jun. 4, 1991

[54] ENGINE DRIVEN HEAT PUMP SYSTEM

[75] Inventors: Sherwood G. Talbert, Columbus; Frank E. Jakob, Worthington, both of Ohio

[73] Assignee: Gas Research Institute, Chicago, Ill.

[21] Appl. No.: 453,755

[22] Filed: Dec. 20, 1989

[51] Int. Cl.[5] ..... F25B 27/00

[52] U.S. Cl. ..... 62/238.7; 62/323.1; 237/2 B

[58] Field of Search ..... 62/238.6, 238.7, 323.1; 237/2 B

[56] References Cited

U.S. PATENT DOCUMENTS

| | | | |
|---|---|---|---|
| 2,738,655 | 3/1956 | Gumpper et al. | 62/323.1 X |
| 3,135,318 | 6/1964 | Carleton | 62/323.1 |
| 3,139,924 | 7/1964 | Schreiner | 62/323.1 |
| 3,421,339 | 1/1969 | Volk et al. | 62/323.1 |
| 4,055,299 | 10/1977 | Norberg et al. | 62/238.6 x |
| 4,256,475 | 3/1981 | Schafer | 237/2 B X |
| 4,292,814 | 10/1981 | Braun | 62/323.1 |
| 4,408,715 | 10/1983 | Gueneau | 62/323.1 |
| 4,510,762 | 4/1985 | Richarts | 62/325 |
| 4,592,208 | 6/1986 | Sollner et al. | 62/323.1 |
| 4,614,090 | 9/1986 | Kaneko et al. | 62/238.6 X |

*Primary Examiner*—William E. Wayner

*Attorney, Agent, or Firm*—Watkins, Dunbar & Pollick

[57] ABSTRACT

A heat pump system selectively operable in cooling and heating modes of operation and having a combustion prime mover which produces refrigerant vapor compression and which produces combustion heat in greater amounts than usable energy for motive power, provided with a first heat exchanger that evaporates compressed refrigerant in the system heating mode of operation and with a first radiator means which transfers excess prime mover heat to a working fluid, and with a working fluid distribution means selectively operable to proportionately flow the heated working fluid to the first radiator in convective heat exchange relations to the first heat exchanger means, in the system heating mode of operation, to provide defrost capabilities and especially to improve heat pumping capacity at low ambient temperatures.

8 Claims, 3 Drawing Sheets

ENGINE DRIVEN HEAT PUMP SYSTEM

FIELD OF THE INVENTION

This invention relates to refrigerant vapor compression heat pump systems that are driven by combustion engine prime movers. More particularly, it relates to improving the winter performance of such systems which have radiators that exchange the unused heat of combustion from the engine with an ambient fluid such as air passing over the radiator.

BACKGROUND OF THE INVENTION

Vapor compression heat pumps are in conventional use and are have become commonly used to provide heating and cooling air conditioning in residential service.

While the predominant motive power for such heat pump systems has been electric motor drive means, a combustion engine is an attractive alternative source of motive power for such systems and has seen some use in this setting.

One drawback of vapor compression heat pump systems is that during winter operation the heating capacity decreases as the ambient temperature of the outside air, being used as the source of heat, goes down. At the same time the building heat loss increases and temperature in the internal ambient living space decreases. A common solution to the problem has been the provision of auxiliary electric heaters to meet the requirements of the total heating load during more severe outside temperature and weather conditions.

The main reason for this reduction of heating capability of the heat pump is that the refrigerant compressor cannot pump very much refrigerant vapor at these extreme operating conditions.

When the compressor is driven by a combustion engine the problem is accentuated because whenever the compressor does not draw much power the engine is relatively lightly loaded, compared to total load capacity, and therefore does not produce much unused heat of combustion for translation to space heating.

One of the advantages of a combustion engine heat pump system is the available excess heat of combustion generated in the engine. The heat is useful for wintertime heating augmentation when cold ambient outside air is the heat source. This relieves the requirement for auxiliary heaters.

However when the engine is lightly loaded, the advantages of the combustion engine driven heat pump system are reduced, since the recovery of engine heat useful for heating purposes in the system is limited and there is less heat available at the time when it would be most useful.

It is a common practice in internal combustion engine driven heat pump systems to recover the unused heat from the engine by conveying a working fluid such as water with an ethylene glycol antifreeze through the cooling system of the engine and through an exhaust heat exchanger where heat is exchanged with the working fluid. The working fluid is then conveyed or pumped to another heat exchanger, or radiator, that is located in the air flow in the air conditioned building.

Patents which have addressed various aspects of the use of combustion engines (including turbines) are found in the prior art and include the following:

U.S. Pat. No. 4,592,208 Sollner et al. discloses a heating or cooling apparatus with an internal combustion engine enclosed in an insulating housing.

U.S. Pat. No. 4,510,762 Richarts reveals a heat recovery method wherein heat from an internal combustion engine is delivered to augment a heat pumping system.

U.S. Pat. No. 4,408,715 Gueneau relates to a heating installation for premises or residential or industrial use.

U.S. Pat. No. 4,292,814 Braun shows a heat pump driven by a free piston engine with fans driven by compressed air.

U.S. Pat. No. 3,421,339 Volk et al. discloses a unidirectional heat pump system. Engine cooling water is used to heat the load, and temperature controlled valves control the amount of flow.

U.S. Pat. No. 3,139,924 Schreiner reveals an internal combustion engine driven heat pump system. A reversible fan blows air across the engine, radiator and refrigeration coil.

U.S. Pat. No. 3,135,318 Carleton relates to a heat pump system which has an internal combustion engine, i.e. a turbine.

As a matter of definition certain preferred terminology is to be used with meanings according to the following.

Within the context herein, an engine driven heat pump system means a system where a vapor compression heat pump is driven by a combustion prime mover of a type to provide motive power to the compressor. Operating in the heating mode means that the engine driven heat pump system is selectively arranged to provide a cooling effect at the outdoor evaporator heat exchanger, and a heating effect at the indoor condenser heat exchanger which is contacting the air of the air conditioned space.

The term "high ambient heating mode" is used to define outside air at temperatures greater than about 15° to 40° F. (−9.5° to 4.5° C.), so that the compressor is operating in a sufficiently loaded condition to pump enough refrigerant vapor for the engine to operate with sufficient load to produce excess heat to augment the heating load on the condenser.

The term "low ambient heating mode" relates to the operating conditions where the outside air as a source of heat is below about 15° F.(−9.5° C.) and the engine would be insufficiently loaded to produce an adequate amount of auxiliary heat to augment the condenser of the vapor compression heat pump system.

The purpose of this invention is to provide a simple way to furnish extra heat load to the vapor compression refrigerant system in an engine driven heat pump system during the low ambient heating mode.

In circumstances when it is advantageous to produce a larger load on the compressor and the engine by loading the engine in this way, the engine operates at a higher horsepower and thereby produces more auxiliary heat. The auxiliary heat is transferred to the engine working fluid which is then transferred to the air flow in the air conditioned building to provide additional heat. A feature of the invention is the provision of a flow proportioning valve in the engine working fluid circuit to divert some of the engine heat to a radiator which is in heat exchange relationship with the outside ambient air. In most instances, air flow will pass first through the engine radiator and then across the outside heat exchanger to increase the rate of transfer of the engine exhaust heat to the refrigerant sub-system in this cold ambient heating mode of operation.

Accordingly, the load on the compressor is increased as some auxiliary heat is transferred to the heat exchanger of the vapor compression subsystem which is operating as an evaporator in the heating mode. An advantage is that the evaporator is therefor operating at a higher temperature and the propensity to develop frost is reduced, thereby reducing another problem that plagues the operation of vapor compressor heat pumps operating under cold ambient outside air conditions.

Other benefits accrue from the increased evaporator temperatures and reduced pressure ratios, so that other types of refrigerants may be used, such as that known as R-12. In addition other types of compressors may become advantageous, such as rotary or sliding vane types.

SUMMARY OF THE DISCLOSURE

In summary the invention includes a heat pump system selectively operable in heating or cooling modes of operation and having a combustion prime mover which produces the compression of refrigerant vapor in the system and which produces auxiliary heat in greater amounts than generally produced by only the compression of refrigerant vapor in the system. It comprises in combination:

a) a first heat exchanger means in heat exchange relation with an ambient atmosphere and functioning as a refrigerant vapor condenser in the system cooling mode of operation and as a refrigerant evaporator in the system heating mode of operation;

b) a recuperator heat exchanger means receiving prime mover excess heat and transferring the heat to a working fluid;

c) a working fluid distribution means selectively operable to flow proportionately said heated working fluid to a first radiator means which is in convection heat transfer relation to the first heat exchanger means; the fluid distribution means flowing the heated working fluid through the first radiator means in heat transfer relations to the first heat exchanger means, when the heat pump system is selectively operating in the heating mode of operation.

The foregoing and other advantages of the invention will become apparent from the following disclosure in which the preferred embodiment of the invention is described in detail and illustrated in the accompanying drawings. It is contemplated that variations and procedures, structural features and arrangement of parts may appear to those skilled in the art without departing from the scope or sacrificing any of the advantages of the invention.

Figure 1:
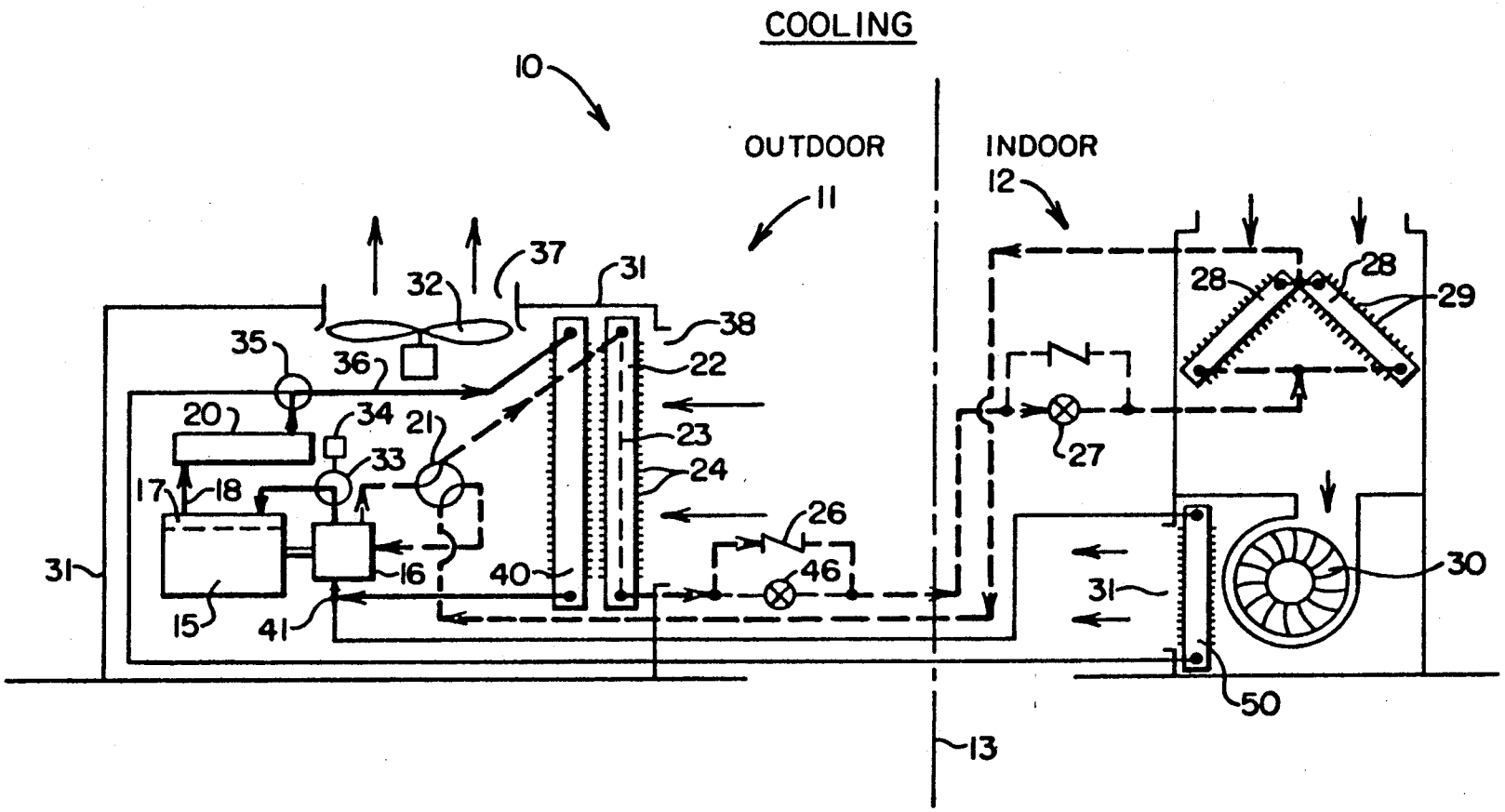
FIG. 1 is schematic diagram of a heat pump system of this invention in which the method of the invention is practiced. The system has been selectively arranged for operation in the cooling mode.

In the following description of the preferred embodiment of the invention which is illustrated in the drawings, specific technology will be used for sake of clarity. However, it is not intended that the inventions be limited to these specific terms so selected or the system so shown and it is to be understood that each specific term includes all the technical equivalents which operate in a similar matter to accomplish a similar purpose.

DETAILED DESCRIPTION OF A PREFERRED EMBODIMENT OF THE INVENTION IN THE BEST MODE

Figure 2:
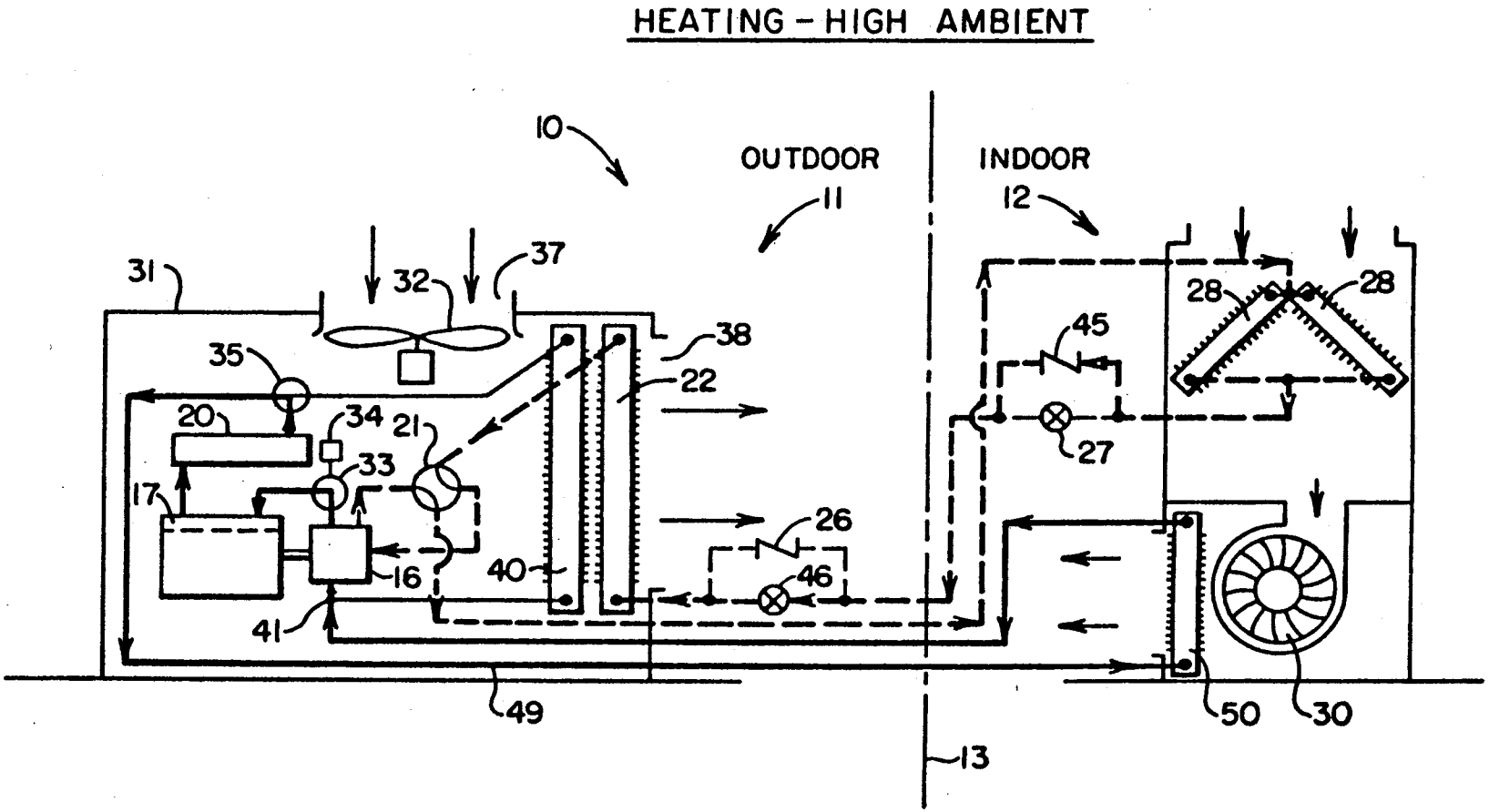
FIG. 2 is a schematic view of the system of this invention in the heating mode with the components selectively arranged for high ambient outdoor air temperature conditions.
Figure 3:
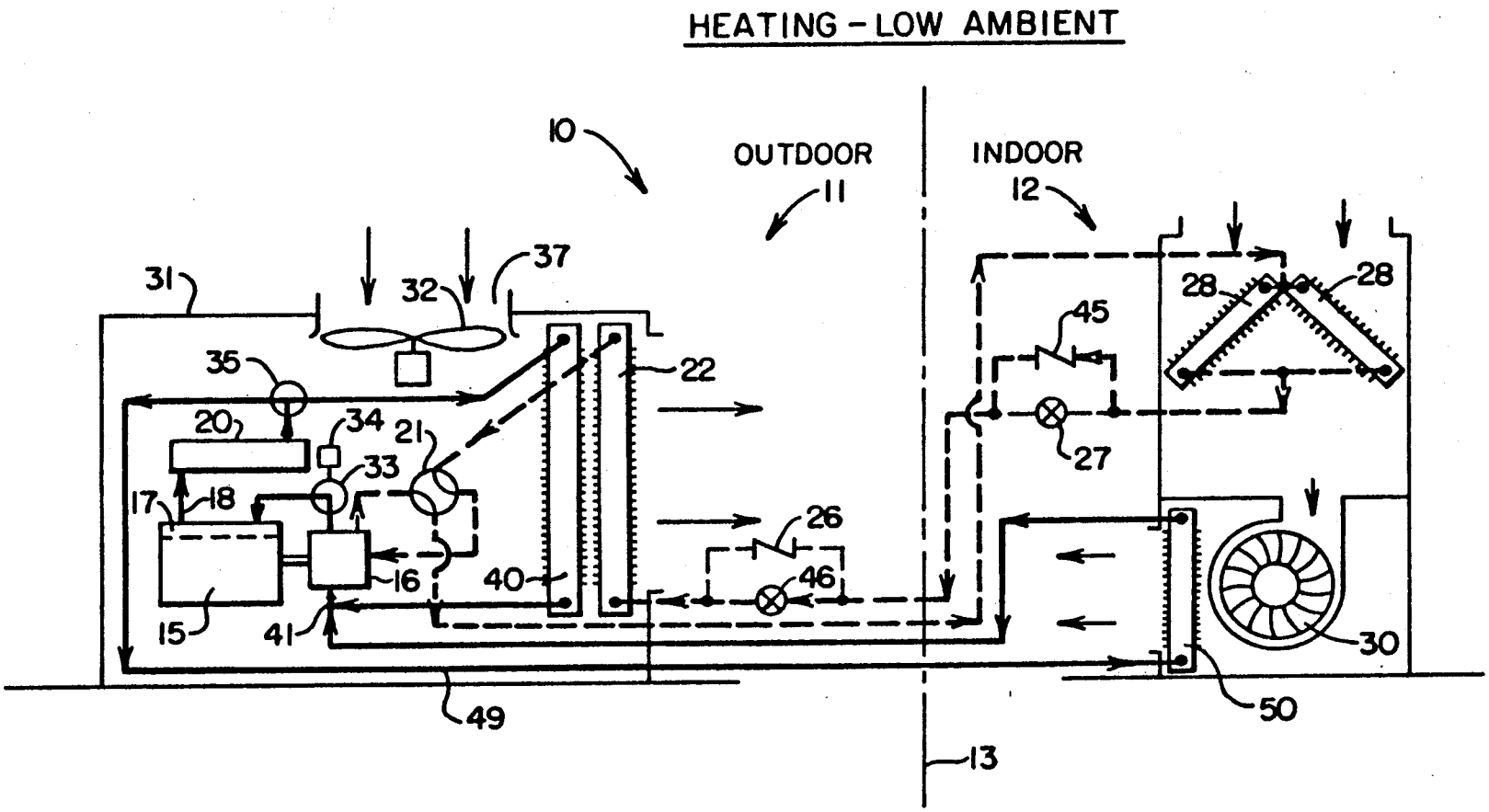
FIG. 3 is a schematic view of the system of this invention with a component selectively arranged for operation in the heating mode with low ambient outdoor air temperature conditions.

Referring to FIGS. 1, 2 and 3, the system, referred to generally as 10 includes an outdoor portion 11 and indoor portion 12, those portions being schematically divided by the line 13.

COOLING MODE

In FIG. 1, the system is shown with the components selectively arranged for operation in the cooling mode, and includes an internal combustion engine 15 mechanically connected to a refrigerant compressor 16. The engine 15 includes a cooling fluid jacket 17 and an exhaust pipe means 18 which flows engine combustion exhaust gases to a muffler/recuperator/heat exchanger means 20.

In the heat pump subsystem, compressed refrigerant vapor is conveyed through a reversing valve 21 which is set to convey the vapor to an outdoor first heat exchanger 22 that functions as a condenser in the system cooling mode. Conduits 23, through the heat exchanger 22, are in conductive connection to a plurality of fins 24. The cooled vapor (which may be all or part liquid) is conveyed through a check valve 26 from the outdoors to the indoors where the vapor then passes through an expansion valve 27. The refrigerant vapor then passes through an indoor second heat exchanger 28 having fins 29 over which air from the living space of the building air is flowed by an air distribution subsystem blower 30. The air circulated by blower 30 is primarily return air from the air conditioned space, entering through a aperture 31, and in the cooling mode represents the load on the system which vaporizes the liquid refrigerant. Some of the air may be fresh air obtained from outside the conditioned space in minor amounts. The warmed refrigerant vapor returns from the heat exchanger 28 to the compressor 16 by way of the reversing valve 21 which is set to bring the vapor back to the compressor 16.

A fan 32 conveys the outside ambient air across the heat exchanger 22 to facilitate the heat exchange between the refrigerant vapor and the outside ambient air which is a heat sink in the cooling mode of operation.

The engine 17, compressor 16 and heat exchanger 22 are enclosed in a housing 31 having apertures 37 and 38. The heat exchanger 22 is juxtapositioned to the aperture 38 so that when the fan 32 is operating to exhaust air from the enclosure 31, in the cooling mode, outside air is induced across the fins 24 of the heat exchanger 22.

The engine 15 and cooling jacket 17 are part of a working fluid subsystem which operates to utilize a part of the heat generated by the engine and not utilized in driving the compressor 16. This heat energy is conveyed to the working fluid by circulation through the jacket 17 and the recuperator heat exchanger 20. The working fluid is preferably a mixture of salt (brine) or glycol with water to provide a liquid capable of being reduced in temperature well below temperatures in the heat source/ambient air passing over the outside heat exchanger 22.

The working fluid subsystem includes a pump 33 driven by an electric motor 34. Alternatively, the pump 33, may be driven by the engine 15. Working fluid is conveyed from the recuperator 20 through a proportioning valve 35.

From the proportioning valve 35, a portion of the working fluid may be flowed through a conduit 36 to a first radiator means 40, which is juxtapositioned to the first heat exchanger 22. Ambient air passing through the housing 31 and across the heat exchanger 22 is directed across the radiator 40, after entering the opening 38, in the cooling mode of operation.

From the first radiator 40 t he working fluid is conveyed through a connection 41 to a manifold of the compressor 16 before passing back to the jacket 17 of the engine 15.

The operation of the system in the cooling mode is according to a conventional vapor compression refrigerant vapor cooling cycle wherein the vapor is compressed in compressor 1 6, condensed in heat exchanger 22, conveyed as a liquid to expansion valve 27 and expanded into the evaporator 28 before being returned to the compressor 16. The excess, or waste heat, from the engine is transferred to the working fluid which circulates through the radiator 40 to provide cooling for the engine and maintain its proper operating temperature.

In some instances a portion of the excess heat may be conveyed to an auxiliary domestic water heater (not shown).

HIGH AMBIENT HEATING MODE

FIG. 2 shows a system 10 arranged for heating mode operation when the outside ambient temperature is above the freezing temperature of water, and the heat pump can meet the heating load of the house in normal fashion.

A typical range for this type of high ambient heating operation is between about 15° F. (−9.5° C.) and 60° F. (15.5° C). The lowest outside ambient temperature is that temperature at which the capacity of the heat being pumped from outside air is reduced to the extent that auxiliary heat input from an additional source is required. It is well known that the capacity of heat pumps falls off as the outdoor temperature decreases due to the change in density of refrigerant.

In this mode the refrigerant vapor from the compressor 16 is conveyed through the reversing valve 21, which has been reversed from the cooling mode, and selectively arranged to convey the refrigerant vapor to the heat exchanger 28 (which is now operating as a condenser) to be cooled by the indoor air which is recirculated by the fan 30. The cooled liquid refrigerant is afterwards conveyed through a check valve 45. The liquid refrigerant then is reduced in pressure through an expansion valve 46 into the outdoor heat exchanger 22 (which is now operating as an evaporator). From the heat exchanger 22, refrigerant vapor returns to the compressor through the reversing valve 21.

In this high ambient heating mode the working fluid circulates, as previously described for the cooling mode except that, a portion or all of the working fluid is diverted by the proportioning valve 35 though a second indoor radiator means 50 from a conduit 49. From the radiator 50, the working fluid is conveyed back to the connection 41 and sent to the condenser manifold 16 and engine jacket 17.

When the system is selectively changed over from the cooling mode to the heating mode, the fan 32 is reversed in a rotational direction by appropriate conventional motor controls. The flow of air through the housing 31 is indicated by arrows at the apertures 37 and 38.

In this mode of operation the heat pump system is operating in a conventional refrigerant vapor reverse compression cycle while the heat from the indoor air is augmented by the circulation of the working fluid through the indoor radiator 50. By this means the heat produced by the engine which might otherwise be wasted is transferred to the house air in the heating mode, thus regaining some of the lost energy not transferred to the compressor by operation of the engine.

LOW AMBIENT HEATING MODE

Referring to FIG. 3, when the outside ambient air temperature is below about 15° F. (−9.5° C.) or when defrosting of heat exchanger 22 is required, and the system is operating in the heating mode, the system is selectively arranged to circulate working fluid through radiator 40 as well as through radiator 50 in proportion to the amount of heat needed in heat exchanger 22 (as this is operating as an evaporator) to raise the temperature of the evaporator causing the compressor to pump more vapor and the engine to operate at higher horsepower, thereby producing more engine heat of combustion. The proportioning of the working fluid flow between the first outdoor radiator 40 and the second indoor radiator 50 is controlled by the proportioning valve 35.

In conjunction with the proportioning control the operation of the fan 32 is reversed in this mode of operation and is operated to draw air in through the aperture 37, pass around the engine and flow out through the radiator 40 and heat exchanger 22. In some instances the fan may be stopped as a further control parameter to the optimum operation of the heat transfer effects between the first outdoor radiator 40 and the first heat exchanger 22. Because of the proximity and juxtapositioned position of radiator 40 and the first heat exchanger 22 a high degree of responsiveness and control of thermal characteristics is created, furthering the enhanced performance of the system.

In a manner conventional to those skilled in the art, temperature and/or pressure sensors are provided for each of the first heat exchanger 22 and second heat exchanger 28 as well as the first radiator 40 and the second radiator 50. The sensors in conjunction with microcontrollers, manage the various components of the system, including the proportioning valve 35, the pump 33, the fans 32 and 30 and the various facets of control for the internal combustion engine 15.

When operating in this mode of operation with the optimum controlled proportion of working fluid being directed through the first radiator 40 and with the fan operating in the "reversed" direction the refrigerant evaporator coil picks up the radiator heat in the winter time. This action increases the load on the compressor and engine but without losing significant heat to the outdoor air. It also has the advantage of increasing the operating temperature of the outdoor refrigerant coil, which reduces frost build-up as well as being an aid in defrosting if frosting occurs. Other benefits accrue from increased evaporator temperatures and reduced pressure ratios so that other types of refrigerants may be used or compressors other than piston cylinder types may be advantageously used, such as rotary or sliding vane units.

This invention provides the ability to increase the heat output of a heat pump driven by a five-horsepower engine from about 25,000 BTU per hour at an outside ambient temperature of 15° F. (−9.5° C.) to almost 50,000 BTU per hour. This then matches the design load of a typical northerly located residential home in the northern hemisphere.

In the above description, the invention has been described in context of a residential air conditioning situation wherein the heat pump is providing refrigeration and/or heating for the environmental air in the living space of a building, primarily a residence. In this situation the cooling or heating load is the air flowing across the indoor heat exchanger and radiator in the air path. Nevertheless, it is within the purview of the invention that other heating or cooling loads could be substituted when other circumstances are presented where the advantages of the invention would be useful.

Although a preferred embodiment of the invention has been herein described, it will be understood that various changes and modifications in the illustrated described structure can be effected without departure from the basic principles of the invention. Changes and modification of this type are therefore deemed to be circumscribed by the spirit and scope of this invention defined by the appended claims or by a reasonable equivalence.

We claim:

1. A heat pump system selectively operable in cooling or heating modes of operation and connected with cooling or heating loads and a heat sink or source to selectively provide heat to or remove heat from the load comprising:

a) a refrigerant vapor compressor motively driven by a combustion prime mover and connected to selectively provide compressed refrigerant vapor to a first heat exchanger in heat exchange relationship with a heat source or sink, or to a second heat exchanger in heat exchange relationship to a load;

b) valve means operable to selectively connect the compressor to the first heat exchanger to operate as a condenser in the cooling mode or to connect the compressor to the second heat exchanger in the heating mode, said first and second heat exchangers connected together to provide a first vapor compression subsystem; and c) a second subsystem comprising: fluid distribution means including a recuperator means in connection with said prime mover connected to flow a working fluid from said prime mover through said recuperator means to recuperate heat generated by said prime move in amounts greater than the usable energy to compress said refrigerant vapor;

d) connecting means between said recuperator and a first radiator means to flow the working fluid through the first radiator means; and additionally flow the working fluid through a second radiator means; and a flow proportioning valve between the first and second radiator means to proportion the flow of working fluid between the first and second radiator means;

e) said first heat exchanger and said first radiator juxtaposed one to the next in position to transfer heat one to the other by ambient air flow of the heat source or sink; and f) said second heat exchanger and said second radiator in heat transfer relation to the load.

2. A heat pump system according to claim 1 wherein the system is selectively operating to flow said heated working fluid to the first radiator which is in heat transfer relation to the first heat exchanger means for rapid defrosting of the first heat exchanger or to improve heat pumping capacity when the ambient atmospheric temperature surrounding and flowing through said first heat exchanger means has a temperature of approximately 15° F. (−9.5° C.) or less.

3. A heat pump system according to claim 1 wherein said first heat transfer means and the first radiator means are enclosed in a housing and juxtaposed one to the other to provide convective ambient air flow from the first radiator means to the first heat exchanger means.

4. A heat pump system according to claim 3 wherein the ambient air flow from the first heat radiator means to the first heat exchanger means is induced by forced air movement through the housing.

5. A heat pump system according to claim 4 wherein the induced ambient air flow is provided by a fan.

6. A heat pump system according to claim 5 wherein the fan means is selectively operable to discontinued operation or reverse flow direction when heat transfer between the first heat radiator means and the first heat exchanger means requires reduced heat transfer.

7. A heat pump system selectively operable in cooling or heating modes of operation and having an internal combustion prime mover which produces the compression of refrigerant vapor in the system and which produces heat in greater amounts than the energy useable for compression of refrigerant vapor in the system, comprising in combination:

a) a first heat exchanger means in heat exchange relation with an ambient atmosphere and functioning as a refrigerant vapor condenser in the system cooling mode of operation and as a refrigerant evaporator in the system heating mode of operation;

b) a recuperator heat exchanger means receiving prime mover heat and transferring said heat to a working fluid;

c) a working fluid distribution means selectively operable to proportionately flow said heated working fluid to a first radiator which is also in convection heat transfer relation to said first heat exchanger means; said fluid distribution means flowing said heated working fluid through a first radiator means in heat transfer relations to said first heat exchanger means, when the heat pump system is selectively operating in the heating mode of operation; and d) wherein the radiator means and the first heat exchanger means are mutually enclosed in a housing having first and second apertures therein and having air induction means juxtaposed to said first aperture with said air induction means selectively operable to induce ambient air flow in a direction to first flow air sequentially from the first heat exchanger means to the first radiator means when the system is operating in the cooling mode, and sequentially reversing the air flow through the first radiator means to the first heat exchanger means when the system is operating in the heating mode.

8. A heat pump system according to claim 7 wherein the first heat exchanger means and the first radiator means are positioned in a housing having a first and second aperture therein with the prime mover mounted within the housing and wherein the first and second apertures are on opposite sides of the first heat exchanger and first radiator means, and the first heat exchanger and first radiator means are juxtaposed one to the next providing for induced air flow and heat transfer between the heat exchange components when induced by said air flow induction means.

* * * * *